US008353088B2

(12) United States Patent
Ha

(10) Patent No.: US 8,353,088 B2
(45) Date of Patent: Jan. 15, 2013

(54) SHOELACE TIGHTENING DEVICE

(75) Inventor: Ki Ho Ha, Busan (KR)

(73) Assignee: Shin Kyung, Inc., Gimhae (KR)

( * ) Notice: Subject to any disclaimer, the term of this patent is extended or adjusted under 35 U.S.C. 154(b) by 750 days.

(21) Appl. No.: 11/993,810

(22) PCT Filed: Sep. 27, 2005

(86) PCT No.: PCT/KR2005/003207

§ 371 (c)(1),
(2), (4) Date: Dec. 17, 2009

(87) PCT Pub. No.: WO2007/001105

PCT Pub. Date: Jan. 4, 2007

(65) Prior Publication Data

US 2010/0101061 A1 Apr. 29, 2010

(30) Foreign Application Priority Data

Jun. 27, 2005 (KR) ..... 10-2005-0055437

(51) Int. Cl.
*A43C 11/00* (2006.01)

(52) U.S. Cl. .... 24/712.5; 24/909; 242/378.1; 242/388.1

(58) Field of Classification Search ..... 24/71.1, 24/68 B, 132 R, 132 AA, 712.1, 712.4, 712.5, 24/712.6, 909; 242/378, 378.1–378.3, 388, 242/388.1–388.5, 385, 385.4; 36/50.1
See application file for complete search history.

(56) References Cited

U.S. PATENT DOCUMENTS

| | | | | |
|---|---|---|---|---|
| 3,197,155 | A * | 7/1965 | Chow | 242/378.3 |
| 4,417,703 | A * | 11/1983 | Weinhold | 242/378.3 |
| 4,633,599 | A * | 1/1987 | Morell et al. | 242/388.1 |
| 4,901,938 | A * | 2/1990 | Cantley et al. | 242/378.1 |
| 4,989,805 | A * | 2/1991 | Burke | 242/378.2 |
| 5,042,177 | A * | 8/1991 | Schoch | 36/50.5 |
| 5,157,813 | A * | 10/1992 | Carroll | 24/68 B |
| 5,335,401 | A | 8/1994 | Hanson | |
| 5,535,531 | A | 7/1996 | Karabed | |
| 6,015,110 | A * | 1/2000 | Lai | 242/388.1 |
| 6,370,743 | B2 | 4/2002 | Choe | |
| 6,871,812 | B1 * | 3/2005 | Chang | 242/378.1 |
| 7,017,846 | B2 * | 3/2006 | Tsoi et al. | 242/378.2 |
| 7,073,279 | B2 | 7/2006 | Min | |
| 2005/0184186 | A1 * | 8/2005 | Tsoi et al. | 242/378.1 |

FOREIGN PATENT DOCUMENTS

WO PCT/KR2005/003207 * 9/2005

* cited by examiner

*Primary Examiner* — Robert J Sandy
(74) *Attorney, Agent, or Firm* — Robert A. Seldon

(57) ABSTRACT

A shoelace tightening device. A housing has a base plate affixed to the tongue of a shoe, and a side wall formed on the base plate. A rotation member has a rotator seated on the side wall of the housing and formed with a ratchet gear on its inner surface, and a bobbin formed on the lower surface of the rotator. A cover is placed on the ratchet gear. A stopper has a head which can slide on the cover, a bridge which extends downward from the head, and a pawl member which is formed on the lower end of the bridge. A coupling shaft is coupled to the base plate and has a stopper housing. The pawl member is received in the stopper housing. A spring is interposed between the inner surface of the stopper housing and an end of the pawl member.

7 Claims, 7 Drawing Sheets

4A

4B

6A

6B

6C

SHOELACE TIGHTENING DEVICE

TECHNICAL FIELD

The present invention relates, in general, to a device for tightening a shoelace and, more particularly, to a shoelace tightening device which is fastened to the upper surface of a tongue arranged at the upper center portion of a shoe and brought into contact with the instep of a foot to wind and thereby tighten a shoelace, wherein a ratchet gear provided to a rotation member to wind and tighten the shoelace is formed on the inner surface rather than the outer surface of the rotation member, and a stopper for restraining rotation of the ratchet gear is positioned inward of the ratchet gear, whereby the size of the shoelace tightening device can be minimized.

BACKGROUND ART

Shoes which are regarded as one of the most important necessities of everyday life are divided into a plurality of kinds depending upon their use. Whatever the use of shoes may be, most shoes are provided with shoelace for fastening the shoes to the feet.

Of course, the shoes must have appropriate sizes for preventing the shoes from coming off of the feet. While it is the norm that the shoelace are loosely knotted for convenience when putting on and taking off the shoes, it is known in the art to be preferable in view of health of the feet that the shoelace be tightened to properly fit the shoes on the feet, so long as the shoes do not excessively compress the feet.

In this regard, since it is very cumbersome to tighten and loosen shoelace every time when putting on and taking off shoes, with the exception of particular cases, the shoes are generally put on and taken off in a state in which the shoelace are maintained in a knotted state. Nevertheless, since the shoelace can come undone during normal walking on a street, inconvenience may be caused in that it is necessary to stop walking and re-tie the shoelace. Even when the shoelace is not undone, since both ends of the shoelace are not appropriately fastened, an untidy external appearance may result. This is especially true for long shoelace.

Moreover, it is not easy for children below early primary school ages or for old persons to properly tighten or loosen shoelace. Specifically, in the case of athletes or persons who participate in various sports such as mountain climbing, cycling, and so on, if the shoelace comes undone due to excessive movement or being caught by foreign objects, undesirable results, such as a decrease in performance and the occurrence of accidents can result. Therefore, it is preferable to reliably prevent the shoelace from coming undone.

Meanwhile, when taking a rest after exercising, it is necessary to easily loosen the tightened shoelace to ensure a sufficient rest. In this regard, it is most preferred that a shoelace be easily tightened, the tightened state of the shoelace be reliably maintained, and then, the shoelace be easily loosened as the occasion demands.

In order to ensure easy tightening and loosening of the shoelace, a plurality of shoelace tightening devices have been disclosed in the art. Korean Utility Model Laid-open Publication No. 1998-69037 describes a shoelace tightening device. The shoelace tightening device comprises a plate which has a T-shaped wall and winding protrusions. The T-shaped wall is defined with grooves and holes through which the shoelace can pass.

In the shoelace tightening device, the shoelace is tightened by passing through the grooves and holes and being wound around the winding protrusions such that the tightened shoelace is prevented from being unintentionally loosened. However, since the shoelace must be tightened through the holes and grooves and around the winding protrusions which are arranged closely to one another, it is not easy for children or old persons to use the shoelace tightening device.

In Korean Utility Model Laid-open Publication No. 1999-2342, there is disclosed a lever type device. This lever type device has a drawback in that, since a shoelace can be tightened only within a range through which a lever can rotate, a tightening range of the shoelace cannot but be decreased.

Korean Utility Model Registration No. 213470 in the name of the present applicant discloses a shoelace winder which uses a ratchet wheel. The shoelace winder is constructed in a manner such that four ends of two shoelace which extend in different directions are wound on an outer surface of a rotation shaft. The shoelace winder suffers from defects in that, since two of the four ends of the shoelace are wound on the rotation shaft after being bent through an angle of about 90° in a case, a winding operation of the shoelace cannot be implemented in a smooth manner. Also, because the four ends of the shoelace are concentratedly wound on a portion of the rotation shaft, unwinding operation of the shoelace cannot be implemented in a smooth manner. Moreover, as the volume of the portion of the rotation shaft on which the shoelace is concentratedly wound increases, the size of the entire shoelace winder increases.

Further, in Korean Utility Model Registration No. 232518, there is disclosed an automatic shoelace adjustment device which uses a ratchet gear structure. The device serves as a shoelace tightening device which comprises a disc-shaped handle provided with a ratchet gear. While this type of shoelace tightening device improves convenience when compared to the above-described shoelace tightening devices, since a switch for restraining rotation of the ratchet gear is operated in the forward and rearward direction outside the ratchet gear, the length of the entire shoelace tightening device cannot but be increased, and the outer appearance of a shoe is deteriorated. Also, if the tongue of a shoe has a short length, the shoelace tightening device cannot be properly attached to the tongue.

DISCLOSURE OF INVENTION

Technical Problem

Accordingly, the present invention has been made keeping in mind the above problems occurring in the prior art, and an object of the present invention is to provide a shoelace tightening device which is minimized in its size such that it has an improved external appearance when fastened to a shoe and can be attached to the tongue of a shoe, said tongue having a short length.

Technical Solution

The above object of the present invention is achieved by a ratchet gear which is formed on the circumferential inner surface thereof with teeth, and a stopper which is meshed with the teeth of the ratchet gear.

In a shoelace tightening device according to the present invention, the ratchet gear is formed on the inner diametric section rather than the circumferential outer surface of a rotation member on which a shoelace is wound. The stopper for preventing unintentional reverse rotation of the ratchet gear is positioned inward of the inner diametric section. Therefore, when compared to a conventional structure in which a stopper is formed on the circumferential outer surface of a ratchet gear, the length of the entire shoelace tightening device can be shortened.

The shoelace tightening device according to the present invention comprises a housing which is securely affixed to the upper surface of the tongue of a shoe, a rotation member which is rotatably assembled to the housing, a stopper which is positioned in the inner diametric section of the rotation member, a cover which covers the upper end of the inner diametric section of the rotation member, a coupling shaft which passes through the rotation member and connects the housing, positioned downward, and the stopper, positioned upward, to each other, the stopper which connects the upper end of the coupling shaft and the cover to each other, and a spring which is disposed in the coupling shaft. The present invention has a characterizing feature that the stopper for restraining the ratchet gear which is formed with the teeth on the circumferential inner surface rather than the circumferential outer surface thereof is positioned in the inner diametric section of the ratchet gear. This feature will be described in detail below.

The housing has a disc-shaped base plate which is securely affixed to the upper surface of the tongue of the shoe through stitching, etc., and a cylindrical side wall which is formed upright on the center portion of the base plate and is defined with a plurality of first shoelace passage holes. The cylindrical side wall performs a function of supporting the rotation member.

The rotation member has a cylindrical rotator and a bobbin. The ratchet gear is formed on the circumferential inner surface of the rotator at a position below the upper end of the rotator. The rotator has an upwardly opened configuration and is defined at the center portion thereof with a circular through-hole. The bobbin is formed on the lower surface of the rotator to extend downward in a vertical direction and is defined with a plurality of second shoelace passage holes. In a state in which the shoelace is captured in the bobbin, the shoelace is wound on the circumferential outer surface of the bobbin.

The inner diametric section of the rotator has a height which is greater than that of the ratchet gear. Due to the presence of the ratchet gear, a stepped portion is formed on the upper end surface of the rotator.

The disc-shaped cover which covers the upper end of the rotator, that is, the rotation member, is placed on the upper end surface of the ratchet gear which is formed on the inner diametric section of the rotator. A groove is defined through the cover to extend from the edge to the center of the cover. A pair of protrusions are formed on the lower surface of the cover at both sides of the groove. The protrusions extend in the lengthwise direction of the groove.

With the cover placed on the upper end surface of the ratchet gear which is formed on the inner diametric section of the rotator, the pair of protrusions are inserted into a stopper housing which is formed on the upper end of the coupling shaft at both sides of the widthwise center portion of the stopper housing. At this time, in order to ensure that the upper surface of the cover does not project beyond or is not depressed below the upper end surface of the rotator, it is preferred that the distance between the upper end surface of the rotator and the upper end surface of the ratchet gear correspond to the thickness of the cover, so that the upper surface of the cover and the upper surface of the rotator are flush with each other.

The stopper for restraining the ratchet gear of the rotation member has a head, a bridge and a pawl member. The head can slidingly reciprocate in a radial direction with its lower surface brought into contact with the upper surface of the cover between the two protrusions. The bridge extends downward from the lower surface of the head through the groove of the cover into the inner diametric section of the rotator. The pawl member is formed on the lower end of the bridge and is positioned in the inner diametric section of the rotator. One end of the pawl member is meshed with the ratchet gear which is formed on the circumferential inner surface of the rotator.

That is to say, as the head is moved on the upper surface of the cover, one end of the pawl member is meshed with the ratchet gear or disengaged from the ratchet gear, whereby reverse rotation of the rotation member is prevented or permitted.

The reverse rotation of the rotation member means the rotation of the rotation member in a direction in which the shoelace is loosened, and the forward rotation of the rotation member means the rotation of the rotation member in a direction in which the shoelace is wound and tightened on the bobbin.

The coupling shaft has a coupling rod and the stopper housing. The coupling rod has a lower end which is brought into contact with the center portion of the bottom surface of the housing and is fastened to the base plate to be prevented from rotating and an upper end which passes through the rotator and is positioned in the inner diametric section of the rotator. The stopper housing has a configuration which is opened on the upper end thereof. The stopper housing is formed on the upper end of the coupling rod. The pawl member of the stopper is slidably received through the edge portion of the stopper housing in the widthwise center portion of the stopper housing, in a manner such that the pawl member can slidingly project through the edge portion of the stopper housing. The spring is interposed between the inner surface of the stopper housing and the other end of the pawl member which faces the inner surface of the stopper housing.

Therefore, the pawl member of the stopper is received in the widthwise center portion of the stopper housing, and the pair of protrusions which are formed on the lower surface of the cover are respectively inserted into the stopper housing of the coupling shaft at both sides of the widthwise center portion of the stopper housing.

The pawl member of the stopper is not inserted in a downward direction into the opened upper end of the stopper housing, but is slidingly received in a radial inward direction through the edge portion of the stopper housing. Also, the pawl member of the stopper is not disassembled in an upward direction from the opened upper end of the stopper housing, but is slidingly removed in a radial outward direction through the edge portion of the stopper housing.

While the coupling shaft does not rotate but is secured to the housing, rotation force is transmitted to the coupling shaft through rotation of the rotation member. In this consideration, it is preferred that the portion of the coupling rod of the coupling shaft which passes through the rotator be formed to have a circular cross-sectional shape, the lower end of the coupling rod be formed to have a polygonal cross-sectional shape rather than a circular cross-sectional shape, the center portion of the base plate of the housing be defined with a polygonal groove, and the lower end of the coupling rod be fitted into the polygonal groove and fastened to the base plate of the housing, such that the rotation of the coupling rod is fundamentally prevented.

At this time, if the lower end of the coupling rod has a circular cross-sectional shape, the lower end of the coupling rod must be fastened to the base plate of the housing, by, for example, at least one pair of bolts which pass through the base plate of the housing, to be prevented from rotating. In this regard, in the event that the lower end of the coupling rod which has the polygonal cross-sectional shape is fitted into and fastened in the polygonal groove defined on the base plate of the housing, it is possible to fasten the coupling rod using only one bolt to prevent it from rotating.

In the shoelace tightening device according to the present invention, constructed as mentioned above, as the lower end of the coupling shaft is fastened to the base plate of the housing which is affixed to the tongue of the shoe, the coupling shaft and the housing are prevented from rotating, and the stopper which is received in the stopper housing formed on the upper end of the coupling shaft and the cover which is formed on the lower surface thereof with the protrusions to be inserted into the stopper housing are also prevented from rotating.

However, the rotation member, which is positioned between the lower surface of the cover and the side wall of the housing, can rotate. To this end, the ratchet gear formed on the inner diametric section of the rotation member on which the cover is placed must not be positioned higher than the lower surface of the cover which is brought into contact with the lower surface of the head of the stopper seated on the stopper housing of the coupling shaft.

In other words, if the upper end surface of the ratchet gear is positioned higher than the lower surface of the cover, when fastening the coupling shaft, to which the stopper and the cover are coupled, to the base plate of the housing, since the lower surface of the cover which is brought into contact with the lower surface of the head of the stopper presses the upper end surface of the ratchet gear, the rotation member cannot be freely rotated.

Because the housing, the rotation member and the cover are sequentially stacked on one another in this way, the rotation member can be rotated. At this time, since one end of the pawl member of the stopper is meshed with the ratchet gear under the influence of the elastic force applied by the spring which intervenes between the inner surface of the stopper housing and the other end of the pawl member, the rotation member can only be rotated in the forward direction.

As a consequence, if the head of the stopper which projects out of the upper surface of the cover is pushed toward the center portion of the cover, one end of the pawl member of the stopper is slidingly retracted into the stopper housing formed on the upper end of the coupling shaft and is disengaged from the ratchet gear, so that the reverse rotation of the rotation member is permitted. If the external force applied to the head of the stopper is removed, one end of the pawl member of the stopper returns to its original position due to the elastic force of the spring to prevent again the reverse rotation of the ratchet gear.

DESCRIPTION OF DRAWINGS

FIG. 4 is views illustrating the operation of the shoelace tightening device according to the present invention, wherein FIG. 4A is a partial cross-sectional view illustrating the state in which a shoelace is tightened, and FIG. 4B is a partial cross-sectional view illustrating the state in which the shoelace is loosened;

FIG. 5 is views illustrating engagement structures between the upper surface of the side wall of a housing and the lower surface of a rotator which constitute the shoelace tightening device according to the present invention, wherein FIG. 5A is a partially enlarged cross-sectional view illustrating the state in which a projection of the rotator is engaged into a groove of the side wall of the housing, FIG. 5B is a partially enlarged cross-sectional view illustrating the state in which stepped portions of the rotator and the side wall of the housing are engaged with each other; and FIG. 5C is a partially enlarged cross-sectional view illustrating the state in which a projection of the side wall of the housing engages with a groove of the rotator;

FIG. 6 is views illustrating a variation of the base plate of the housing according to the present invention, wherein FIG. 6A is an exploded perspective view, FIG. 6B is an exploded cross-sectional view, and FIG. 6C is an assembled cross-sectional view.

BEST MODE

Figure 1:
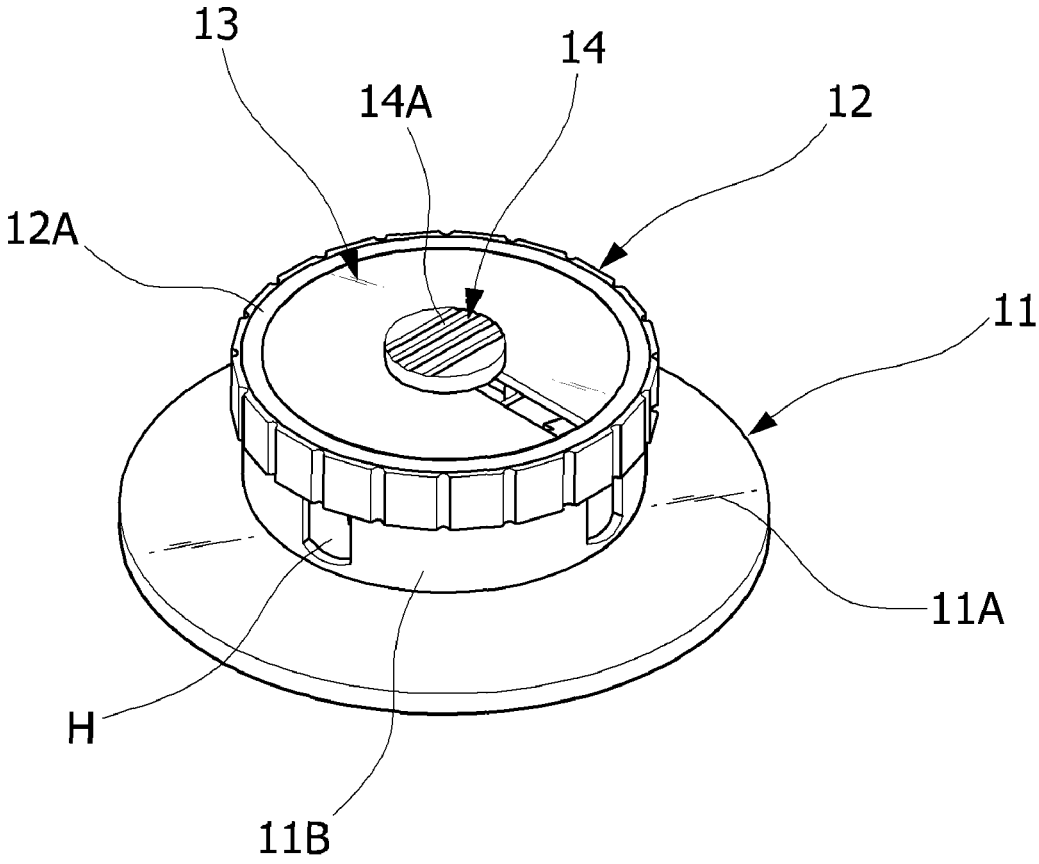
FIG. 1 is a perspective view illustrating a shoelace tightening device in accordance with an embodiment of the present invention.

Reference should now be made to the drawings, in which the same reference numerals are used throughout the different drawings to designate the same or similar components.

Figure 2:
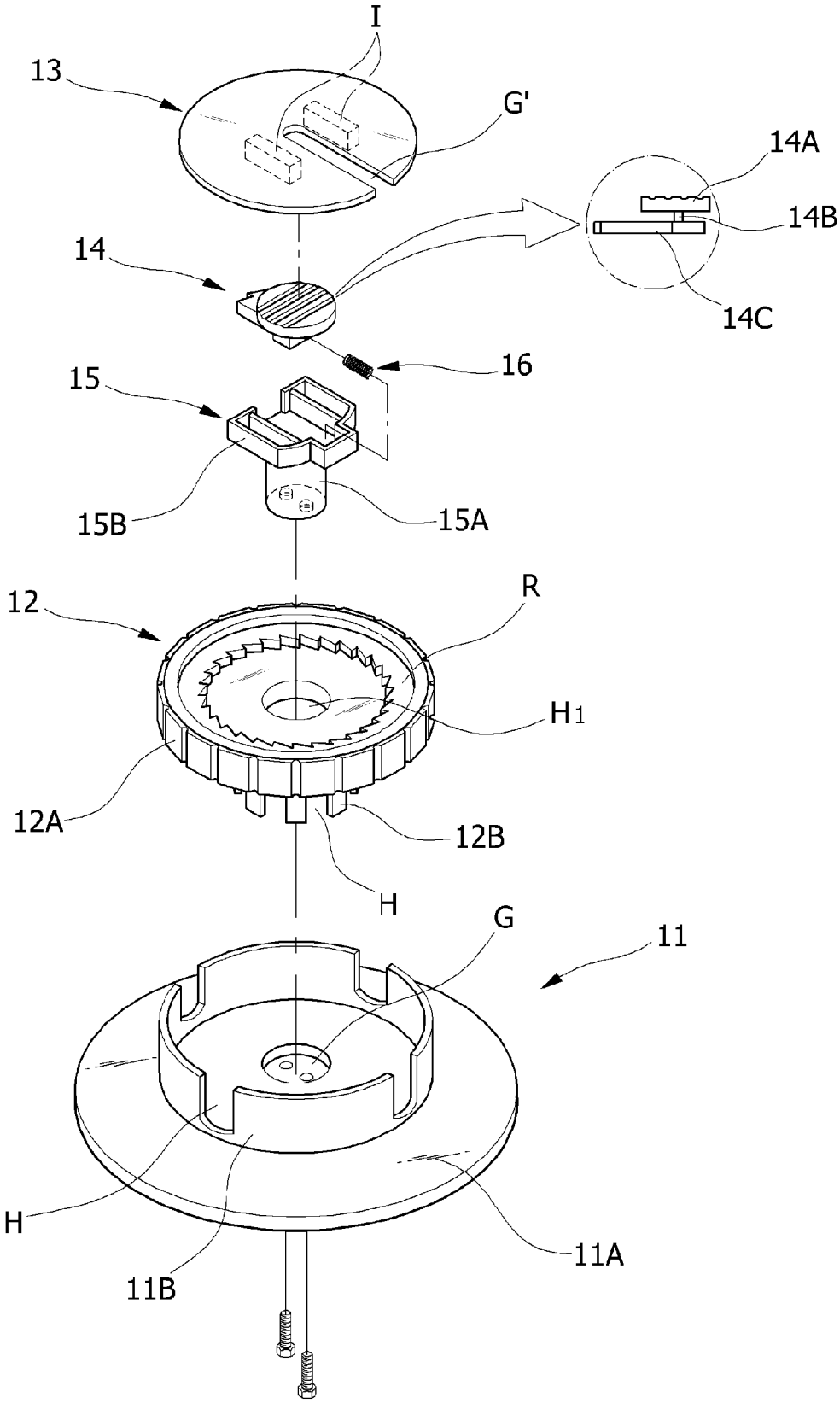
FIG. 2 is an exploded perspective view illustrating the shoelace tightening device according to the present invention.
Figure 3:
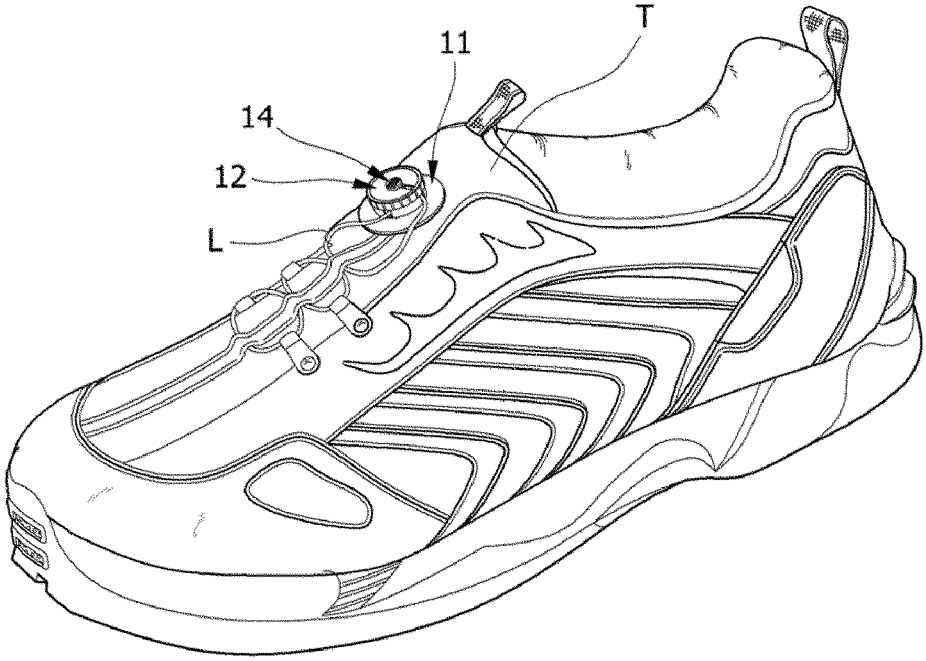
FIG. 3 is a perspective view illustrating an in-use state of the shoelace tightening device according to the present invention.
Figure 4:
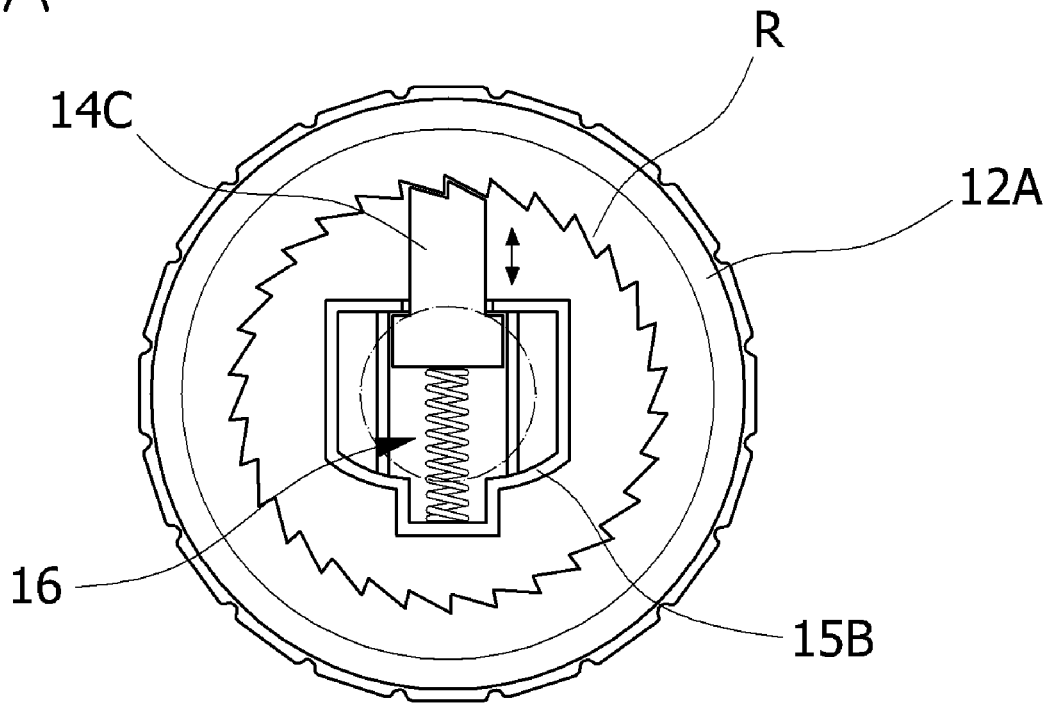
Figure 4:
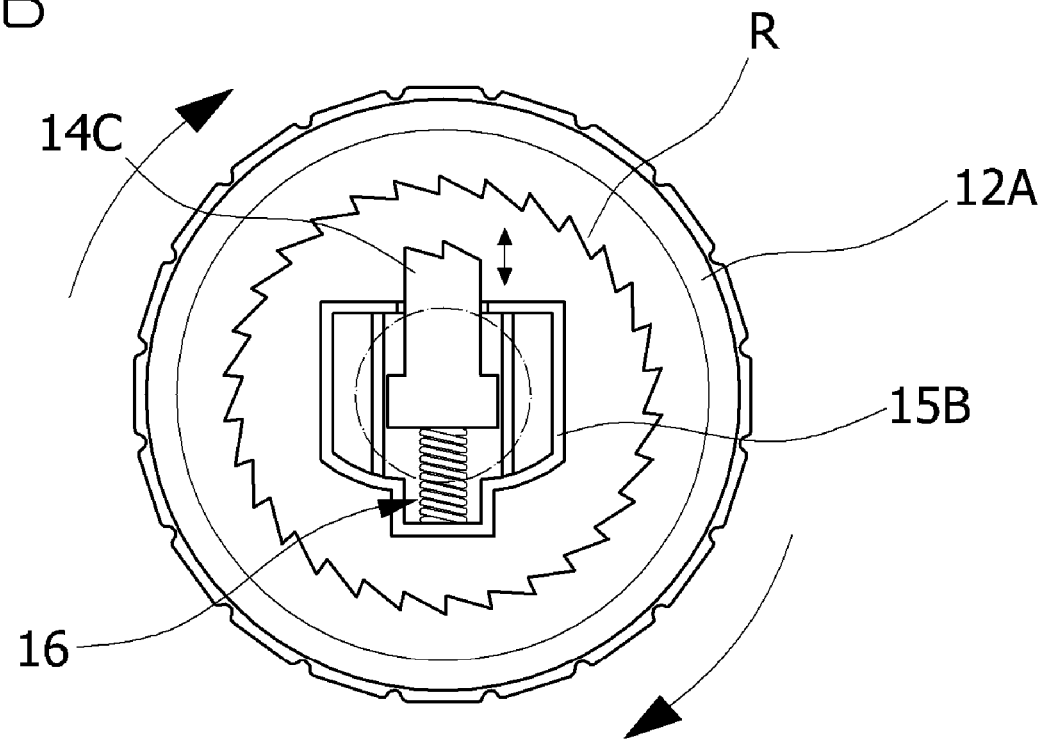

FIG. 1 is a perspective view illustrating a shoelace tightening device in accordance with an embodiment of the present invention, FIG. 2 is an exploded perspective view illustrating the shoelace tightening device according to the present invention, FIG. 3 is a perspective view illustrating an in-use state of the shoelace tightening device according to the present invention, and FIG. 4 is views illustrating the operation of the shoelace tightening device according to the present invention.

As shown in these drawings, a shoelace tightening device according to the present invention includes a housing 11, a rotation member 12, a cover 13, a stopper 14, a coupling shaft 15, and a spring 16.

The housing 11 has a disc-shaped base plate 11A and a cylindrical side wall 11B. The base plate 11A is affixed to the upper surface of the tongue T of a shoe. A groove G is defined on the upper surface of the center portion of the base plate 11A such that the lower end of the coupling shaft 15 can be fitted into the groove G and fastened to the base plate 11A. The side wall 11B is formed upright around the center portion of the base plate 11A and is defined with a plurality of first shoelace passage holes H through which ends of a shoelace L can pass.

The rotation member 12 has a cylindrical rotator 12A and a bobbin 12B. The rotator 12A is seated on the upper surface of the side wall 11B of the housing 11. A ratchet gear R is formed on the circumferential inner surface of the rotator 12A. The ratchet gear R has a height which is lower than that of the inner diametric section of the rotator 12A. A through-hole H is defined through the center portion of the rotator 12A. The bobbin 12B is formed on the lower surface of the rotator 12A, extends downward in a vertical direction, and is positioned in the side wall 11B of the housing 11. The bobbin 12B is defined with a plurality of second shoelace passage holes H through which the ends of the shoelace L can pass. The bobbin 12B has the same axis as the rotator 12A.

The cover 13 has a disc-shaped configuration. The cover 13 is placed on the upper end surface of the ratchet gear R of the rotation member 12. A groove G' is defined in the cover 13 to extend from the edge to the center of the cover 13. A pair of protrusions I are formed on the lower surface of the cover 13 at both sides of the groove G'. The protrusions I extend in the lengthwise direction of the groove G'. The pair of protrusions I are respectively inserted into the stopper housing 15B of the coupling shaft 15 at both sides of the widthwise center portion of the stopper housing 15B.

The stopper 14 has a head 14A, a bridge 14B and a pawl member 14C. The head 14A can slidingly reciprocate in a radial direction with its lower surface brought into contact with the upper surface of the cover 13. The bridge 14B extends downward from the lower surface of the head 14A through the groove G' of the cover 13. The pawl member 14C is formed on the lower end of the bridge 14B and is positioned in the inner diametric section of the rotator 12A. One end of the pawl member 14C is meshed with the ratchet gear R which is formed on the inner surface of the rotator 12A.

The coupling shaft 15 has a coupling rod 15A, and the stopper housing 15B. The coupling rod 15A has a lower end which is fitted into the groove G of the housing 11 and is fastened to the base plate 11A, and an upper end which passes through the through-hole $H_1$ of the rotation member 12 and is positioned in the inner diametric section of the rotator 12A. The stopper housing 15B has a configuration which is open on the upper end thereof. The stopper housing 15B is formed on the upper end of the coupling rod 15A. The pawl member 14C of the stopper 14 is slidably received through the edge portion of the stopper housing 15B in the widthwise center portion of the stopper housing 15B, in a manner such that the pawl member 14C can slidingly project through the edge portion of the stopper housing 15B. As described above, the pair of protrusions I which are formed on the lower surface of the cover 13 are respectively inserted into the stopper housing 15B of the coupling shaft 15 at both sides of the widthwise center portion of the stopper housing 15B.

The spring 16 is interposed between the inner surface of the stopper housing 15B and the other end of the pawl member 14C which faces the inner surface of the stopper housing 15B.

Figure 5:
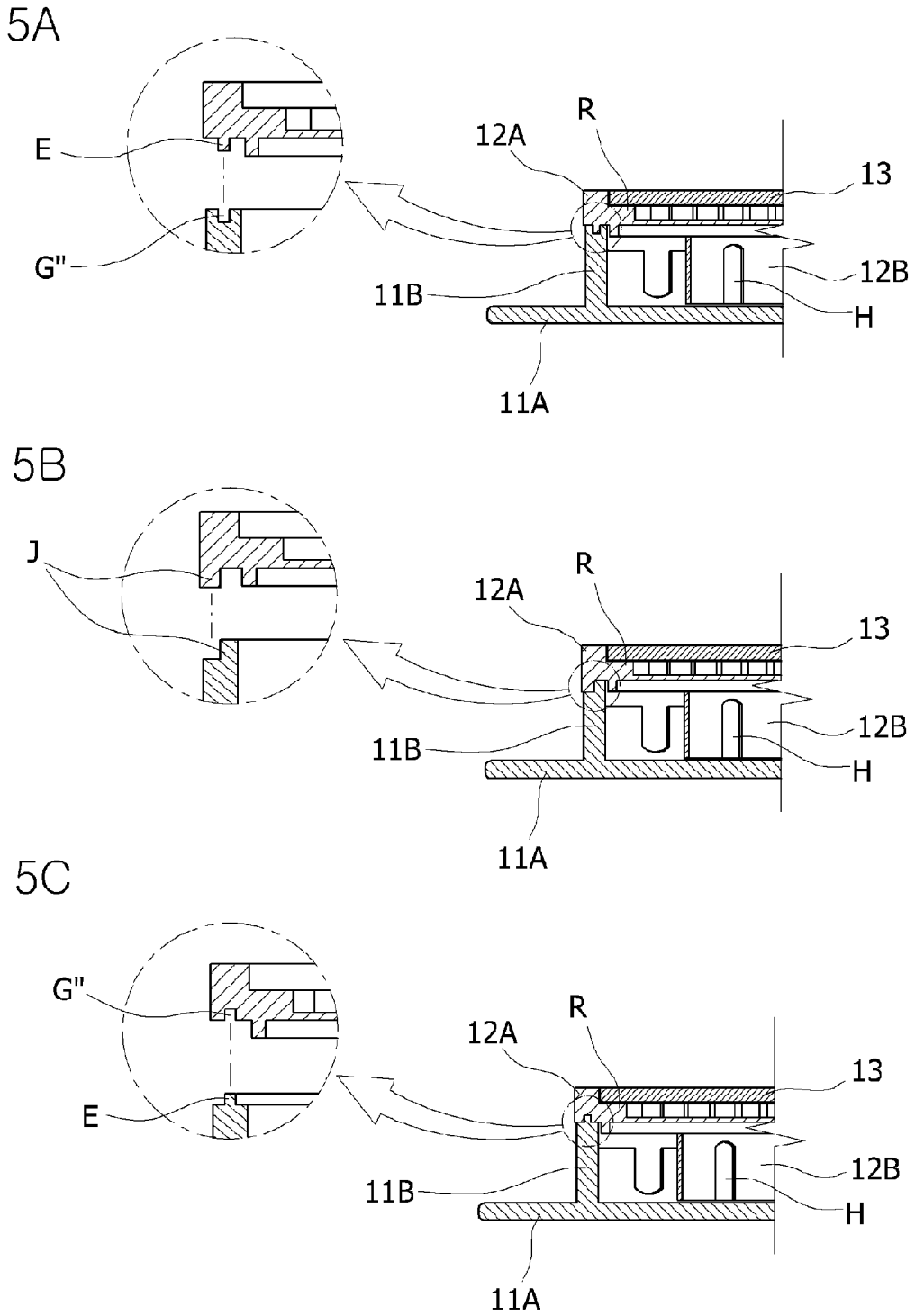

In the shoelace tightening device according to the present invention, constructed as mentioned above, the rotation member 12 can rotate between the side wall 11B of the housing 11 and the cover 13, which is non-rotatably secured to the base plate 11A of the housing 11 by way of the coupling shaft 15 and the stopper 14. In order to minimize the fluctuation of the rotation member 12 in a diametric direction and ensure smooth rotation of the rotation member 12, as shown in FIG. 5, it is preferred that the upper surface of the side wall 11B of the housing 11 be formed with an annular stepped portion J, an annular projection E or an annular groove G', and that the peripheral portion of the lower surface of the rotator 12A of the rotation member 12 be formed with an annular stepped portion J, groove G' or projection E which is engaged with the stepped portion J, projection E or groove G' formed on the upper surface of the side wall 11B of the housing 11.

The shoelace tightening device according to the present invention is small enough to be attached to the tongue of a shoe. While substantial external force can be applied to the shoelace tightening device to tighten a shoelace, the coupling shaft 15 must not be rotated by external force. In this regard, if the housing 11 is made of synthetic resin, the coupling shaft 15 and the housing 11 may be deformed or damaged in a region where they are coupled to each other.

Figure 6:
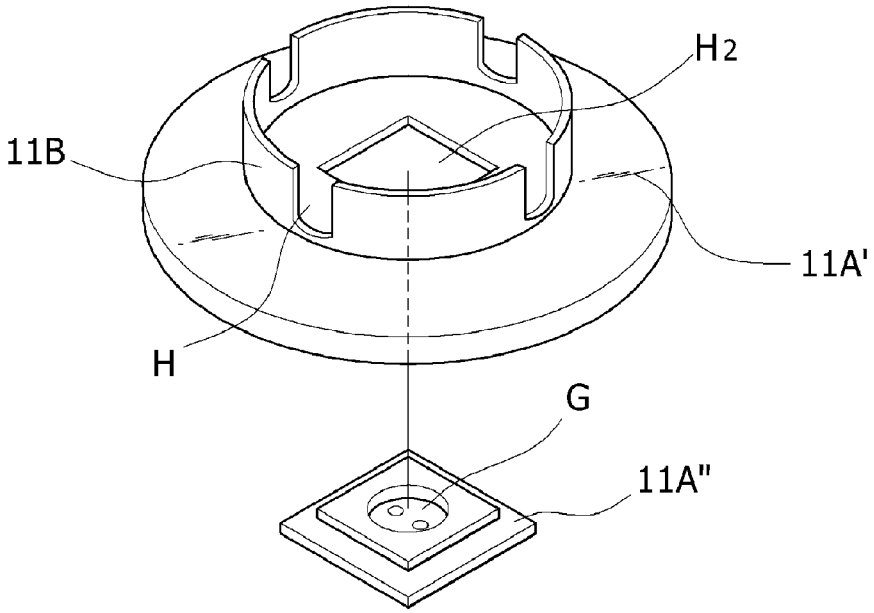
Figure 6:
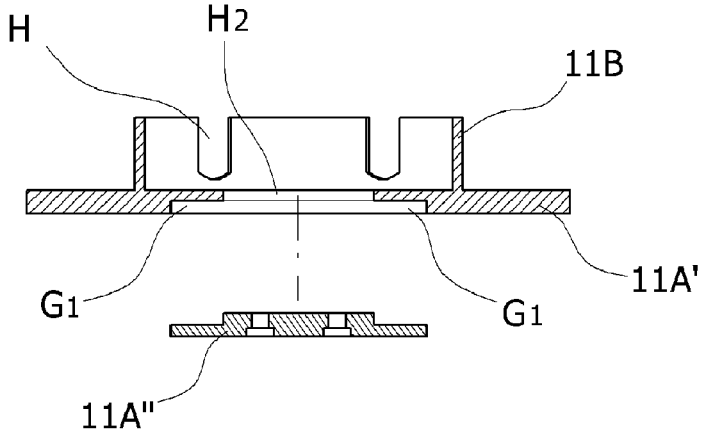
Figure 6:
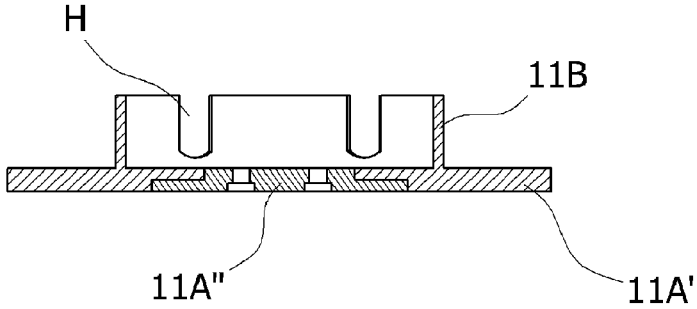

Accordingly, in order to cope with this problem, as shown in FIG. 6, the base plate of the housing 11 comprises a main base plate 11A' and an auxiliary base plate 11A'. The main base plate 11A' has a polygonal opening $H_2$ which is defined through the center portion of the main base plate 11A' and a polygonal groove $G_1$ which is defined on the lower surface of the main base plate 11A' around the polygonal opening $H_2$. The auxiliary base plate 11A' is fitted into the polygonal opening $H_2$ and the polygonal groove $G_1$ such that the upper and lower surfaces of the auxiliary base plate 11A' are respectively flush with the upper and lower surfaces of the main base plate 11A'. The auxiliary base plate 11A' is defined on the upper surface of the center portion thereof with a groove G. The lower end of the coupling shaft 15 is fitted into the groove G and fastened to the auxiliary base plate 11A'. It is preferred that the auxiliary base plate 11A' be formed of hard synthetic resin or metal.

The auxiliary base plate 11A' is fitted into the main base plate 11A' on the lower surface of the main base plate 11A'.

In the shoelace tightening device according to the present invention, constructed as mentioned above, in order to loosen the shoelace, since the rotation member 12 must be rotated in a reverse direction with the stopper 14 retracted into the coupling shaft 15, inconvenience may be caused.

Therefore, in order to ensure that the shoelace is automatically loosened, the shoelace tightening device can be constructed as described below.

Figure 7:
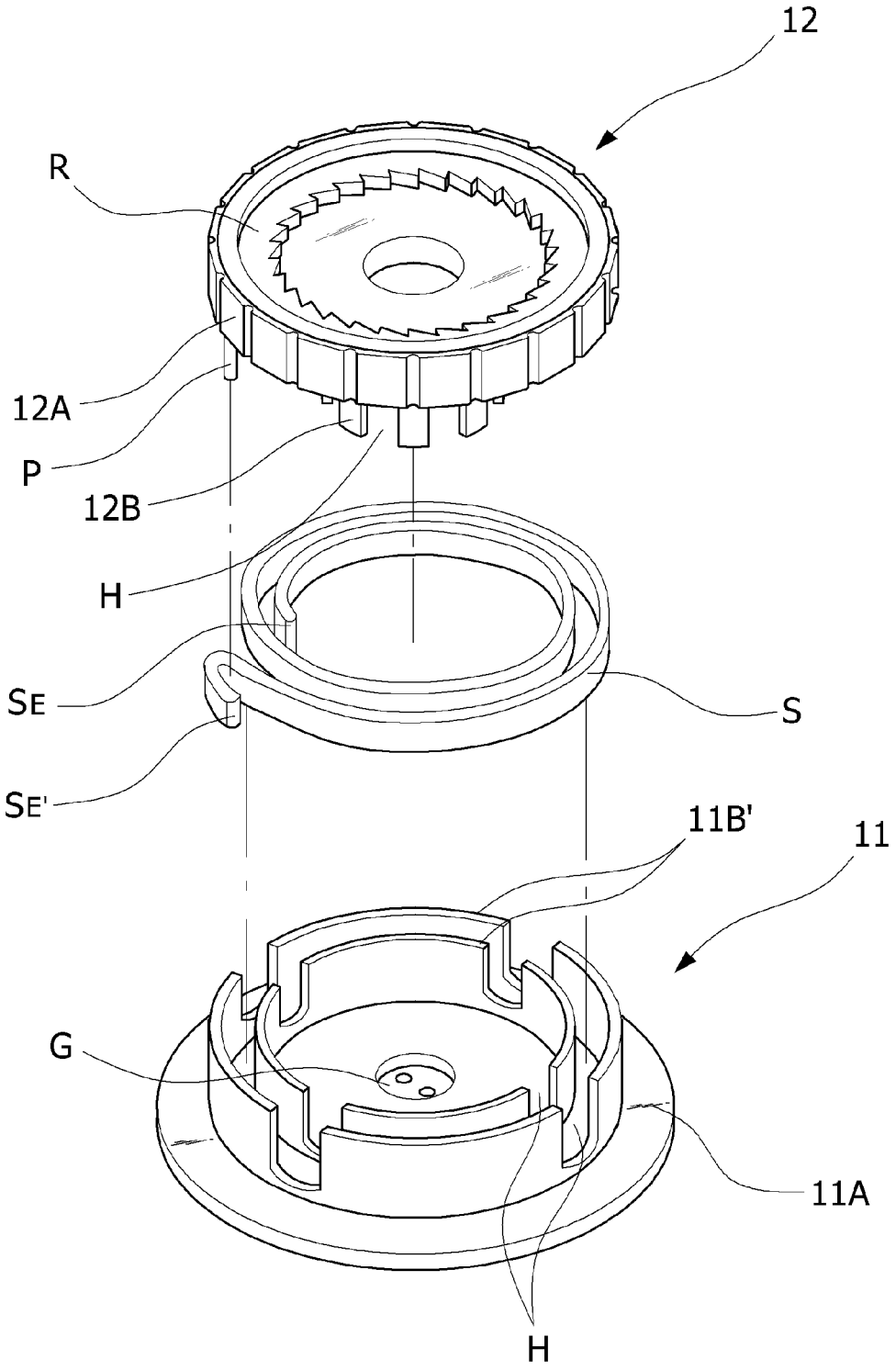
FIG. 7 is an exploded perspective view illustrating a shoelace tightening device in accordance with another embodiment of the present invention.

That is to say, as shown in FIG. 7, the side wall of the housing 11 is formed as a double side wall 11B', and an elastic element S which is rolled in the shape of a coil is disposed in the double side wall 11B'. It is preferred that one end of the elastic element S be secured with respect to the double side wall 11B' and the other end of the elastic element S be secured to a pin element P which projects from the lower surface of the rotator 12A of the rotation member 12.

Due to the fact that both ends of the elastic element S are secured as described above, if the rotation member 12 is rotated in a forward direction to tighten the shoelace, the elastic element S is distorted in such a way as to be brought into close contact with the circumferential outer surface of the inner side wall portion of the double side wall 11B'. In this state, if the pawl member 14C of the stopper 14 is disengaged from the ratchet gear R, the rotation member 14 is automatically rotated in the reverse direction by elastic force of the elastic element S which is forced to return to its original shape.

At this time, since the shoelace must be wound on the bobbin 12B after passing through the lower part of the inner side wall portion of the double side wall 11B', the height of the elastic element S must be lower than that of the double side wall 11B' and disposed in the upper part of the double side wall 11B'. To this end, it is preferred that support members (not shown) for supporting the elastic element S be projectedly formed on the opposite surfaces of the double side wall 11B'.

INDUSTRIAL APPLICABILITY

As is apparent from the above description, the shoelace tightening device according to the present invention provides advantages in that, since gear teeth are formed on the circumferential inner surface of a ring-shaped ratchet gear and a stopper to be meshed with the ratchet gear is positioned inward of the ratchet gear, the length of the entire shoelace tightening device is shortened and miniaturization of the shoelace tightening device is possible. Also, because the shoelace tightening device as a whole has a cylindrical configuration, the external appearance of the shoelace tightening device is improved. Further, due to the fact that a coil-shaped elastic body is disposed in a housing, convenience is improved when using the shoelace tightening device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A shoelace tightening device comprising:

a housing having a disc-shaped base plate, and a cylindrical side wall which is formed upright on a center portion of the base plate and is defined with a plurality of first shoelace passage holes;

a rotation member having a cylindrical rotator which is seated on a peripheral portion of its lower surface onto an upper surface of the side wall of the housing and is formed with a ratchet gear on its inner surface, and a bobbin which is formed on a lower surface of the rotator to extend downward in a vertical direction and is defined with a plurality of second shoelace passage holes;

a cover placed on an upper surface of the ratchet gear, defined with a groove which extends from an edge to a center of the cover, and having a pair of protrusions which are formed on a lower surface of the cover on both sides of the groove;

a stopper having a head which can slide on an upper surface of the cover, a bridge which extends downward from the head through the groove of the cover, and a pawl member which is formed on a lower end of the bridge to be meshed with the ratchet gear at one end thereof;

a coupling shaft having a coupling rod which is coupled at a lower end thereof to the center portion of the base plate of the housing and extends through a center portion of the rotation member to allow its upper end to be positioned in the rotator, and an upwardly open stopper housing which is formed on the upper end of the coupling rod, the pawl member of the stopper being received in a widthwise center portion of the stopper housing to slide in a horizontal direction, and the protrusions formed on the lower surface of the cover being inserted into the stopper housing at both sides of the widthwise center portion of the stopper housing; and a spring interposed between an inner surface of the stopper housing and the other end of the pawl member.

2. The shoelace tightening device as set forth in claim 1, wherein a height of the ratchet gear is lower than that of an inner diametric section of the rotator.

3. The shoelace tightening device as set forth in claim 1, wherein the rotator and the bobbin have the same axis.

4. The shoelace tightening device as set forth in claim 1, wherein the upper surface of the side wall of the housing is formed with an annular stepped portion, projection or groove, and the peripheral portion of the lower surface of the rotator of the rotation member is formed with an annular stepped portion, groove or projection which engages with the stepped portion, projection or groove formed on the upper surface of the side wall of the housing.

5. The shoelace tightening device as set forth in claim 1, wherein the base plate of the housing comprises:

a main base plate having a polygonal opening which is defined through a center portion of the main base plate and a polygonal groove which is defined on the lower surface of the main base plate around the polygonal opening; and an auxiliary base plate fitted into the polygonal opening and the polygonal groove such that upper and lower surfaces of the auxiliary base plate are respectively flush with upper and lower surfaces of the main base plate, the auxiliary base plate being defined on a center portion thereof with a groove into which the lower end of the coupling shaft is inserted.

6. The shoelace tightening device as set forth in claim 5, wherein the auxiliary base plate is formed of hard synthetic resin or metal.

7. A shoelace tightening device comprising:

a housing having a disc-shaped base plate, and a cylindrical double side wall which is formed upright on a center portion of the base plate and is defined with a plurality of first shoelace passage holes, the cylindrical double side wall possessing an elastic element which is disposed in the cylindrical double side wall and has one end secured to the cylindrical double side wall;

a rotation member having a cylindrical rotator which is seated on an upper surface of the double side wall of the housing and is formed with a ratchet gear on its inner surface, and a cylindrical bobbin which is formed on a lower surface of the rotator to extend downward in a vertical direction and is defined with a plurality of second shoelace passage holes, the cylindrical rotator having formed on a lower surface thereof a pin element to which the other end of the elastic element is secured;

a cover placed on an upper surface of the ratchet gear, defined with a groove which extends from an edge to a center of the cover, and having a pair of protrusions which are formed on a lower surface of the cover at both sides of the groove;

a stopper having a head which can slide on an upper surface of the cover, a bridge which extends downward from the head through the groove of the cover, and a pawl member which is formed on a lower end of the bridge to be meshed with the ratchet gear at one end thereof;

a coupling shaft having a coupling rod which is coupled at a lower end thereof to the center portion of the base plate of the housing and extends through a center portion of the rotation member to allow its upper end to be positioned in the rotator, and an upwardly open stopper housing which is formed on the upper end of the coupling rod, the pawl member of the stopper being received in a widthwise center portion of the stopper housing to slide in a horizontal direction, and the protrusions formed on the lower surface of the cover being inserted into the stopper housing at both sides of the widthwise center portion of the stopper housing; and a spring interposed between an inner surface of the stopper housing and the other end of the pawl member.

* * * * *